US009978348B2

(12) United States Patent
Crouch

(10) Patent No.: US 9,978,348 B2
(45) Date of Patent: May 22, 2018

(54) THUMB GUARD APPARATUS AND METHOD OF USING SAME

(71) Applicant: Jerry Crouch, Memphis, TN (US)

(72) Inventor: Jerry Crouch, Memphis, TN (US)

( * ) Notice: Subject to any disclaimer, the term of this patent is extended or adjusted under 35 U.S.C. 154(b) by 0 days. days.

(21) Appl. No.: 15/048,914

(22) Filed: Feb. 19, 2016

(65) Prior Publication Data

US 2017/0365240 A1 Dec. 21, 2017

(51) Int. Cl.
*G10D 3/18* (2006.01)

(52) U.S. Cl.
CPC ..... *G10D 3/18* (2013.01)

(58) Field of Classification Search
CPC ..... G10D 3/00; G10D 3/18; G10G 5/00
See application file for complete search history.

(56) References Cited

U.S. PATENT DOCUMENTS 2,452,396 A * 10/1948 Shopmaker ..... G10D 3/16 84/282

* cited by examiner

*Primary Examiner* — Kimberly Lockett
(74) *Attorney, Agent, or Firm* — Baker, Donelson, Bearman, Caldwell & Berkowitz, P.C.

(57) ABSTRACT

A thumb guard apparatus comprising a flat panel portion with a front and back side is disclosed. In one embodiment, the thumb guard apparatus comprises a curved portion or lip contiguous to the flat panel portion, wherein the curved portion or lip extends from the flat panel portion and curves away from the back side of the flat panel portion creating a channel. The channel creates a space which guards the thumb of a guitar player and prevents the thumb from moving on or over the top of the neck of the guitar. The flat panel portion of the apparatus may be attached to the back of the neck of the guitar. A method of use is also disclosed.

2 Claims, 1 Drawing Sheet

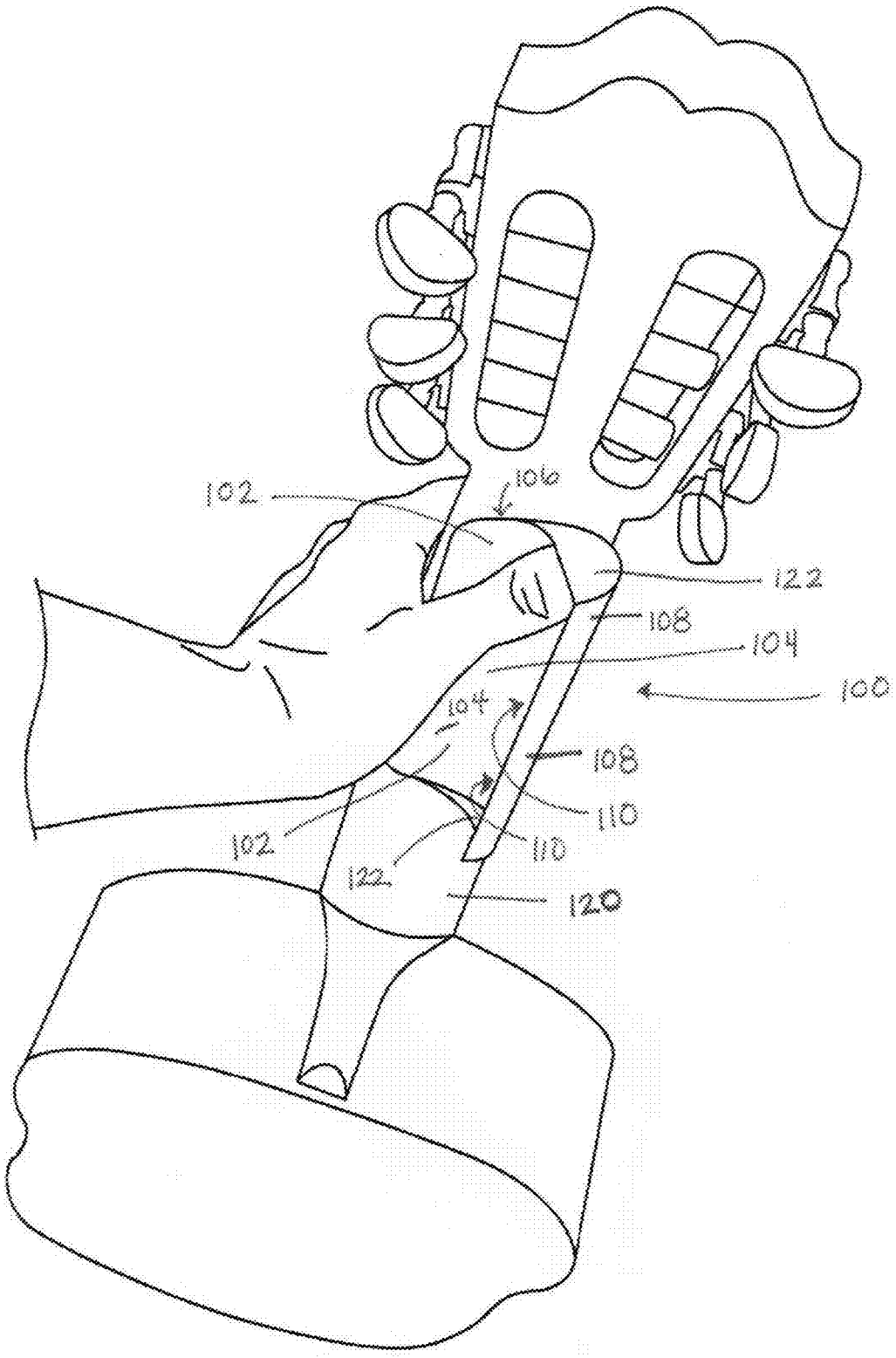
102
106
122
108
104
100
104
108
110
102
110
122
120

THUMB GUARD APPARATUS AND METHOD OF USING SAME

FIELD

The disclosure is related to a thumb guard apparatus used when playing a stringed instrument, namely the guitar, wherein the thumb guard apparatus allows the thumb to maintain proper placement while playing the guitar.

BACKGROUND

Learning the proper technique for playing guitar, namely classical guitar, can be difficult. Guitar teachers, classical or otherwise, instruct a student to keep his or her thumb in the middle of the neck on the back of a guitar while the student positions his or fingers on the proper strings in the proper fret board to achieve playing the intended note. However, a student commonly positions his or her thumb near the top of the neck of the guitar or even positions his or her thumb over the neck of the guitar making the thumb visible to an audience.

An apparatus and method of use which guards the thumb and prevents the user from moving his or her thumb above the neck of a guitar when playing the guitar is needed.

BRIEF DESCRIPTION OF THE DRAWING

FIG. 1 is a perspective view of a thumb guard apparatus for allowing the thumb to maintain proper placement while playing a guitar according to one example embodiment.

DETAILED DESCRIPTION

With reference next to the drawing, there is shown an apparatus and method of use for allowing the thumb to maintain proper placement while playing a stringed instrument, namely a guitar, according to one example embodiment. Referring to FIG. 1, the thumb guard apparatus 100 may be attached to the back of the neck 120 of the guitar, or other stringed instrument, as seen in FIG. 1. Placement of the thumb guard apparatus 10 on the back of the neck 120 of the stringed instrument prevents the thumb guard apparatus 100 from being seen from others sitting in front of the stringed instrument being played. In one embodiment, the thumb guard apparatus 100 may be removably attached to the neck 120 of a guitar, or other stringed instrument, with velcro or with adhesive, but any other attaching means may be used as desired by one skill in the art.

In one example embodiment, the thumb guard apparatus 100 is made of a plastic material, but any other material may be used as desired by one of skill in the art. In one embodiment, the thumb guard apparatus 100 comprises a flat panel portion 102 with a front side 104 and back side 106. In one embodiment, the thumb guard apparatus 100 comprises a curved portion 108 or lip contiguous to the flat panel portion 102, wherein the curved portion 108 or lip extends from the flat panel portion 102 and curves away from the back side 106 of the flat panel portion 102 creating a channel 110. Two side ends 122 are on the sides of the channel created by the flat panel portion 102 and the curved portion 108. The channel 110 creates a space which guards the thumb and prevents it from moving on or over the top of the neck 120 of the guitar. The flat panel portion 102 of the apparatus 100 may be attached to the back of the neck 120 of the guitar. In one embodiment, the thumb guard apparatus 100 has a length of about three inches. The thumb guard apparatus 100 may vary in length as desired by one skill in the art. In one embodiment, the thumb guard apparatus 100 may range from two to five inches in length. In another embodiment, the height of the thumb guard apparatus 100 may be about one to two inches but other heights may be used depending on the size of the neck 120 of the stringed instrument.

A method of use for the thumb guard apparatus 100 is also disclosed. The method comprises (1) removably attaching the thumb guard apparatus 100, described above, to the neck of the guitar, or other stringed instrument, as shown in FIG. 1 and (2) playing the guitar.

The foregoing disclosure has been set forth merely to illustrate the invention and is not intended to be limiting. Since modification of the disclosed embodiments incorporating the spirit and substance of the invention may occur to persons skilled in the art, the invention should be construed to include everything within the scope of the disclosed invention and equivalents thereof.

I claim:

1. A thumb guard apparatus comprising a flat panel portion, a curved portion and two side ends, wherein the curved portion is contiguous to the flat panel portion, wherein the flat panel portion has a front side and a back side, wherein the curved portion extends from the flat panel portion and curves away from the back side of the flat panel portion creating a channel, wherein the two side ends are on the sides of the channel created by the flat panel portion and curved portion.

2. A method of use for allowing the thumb to maintain proper placement while playing a stringed instrument, wherein the method comprises the following steps: (1) removably attaching the thumb guard apparatus to the neck of the stringed instrument, wherein the thumb guard apparatus comprises a flat panel portion, a curved portion and two side ends, wherein the curved portion is contiguous to the flat panel portion, wherein the flat panel portion has a front side and a back side, wherein the curved portion extends from the flat panel portion and curves away from the back side of the flat panel portion creating a channel, wherein the two side ends are on the sides of the channel created by the flat panel portion and curved portion, and (2) playing the stringed instrument.

* * * * *